US006883478B2

(12) United States Patent
Borraccia et al.

(10) Patent No.: US 6,883,478 B2
(45) Date of Patent: Apr. 26, 2005

(54) FAST-ACTING LOCK PIN ASSEMBLY FOR A VANE-TYPE CAM PHASER

(75) Inventors: Dominic Borraccia, Spencerport, NY (US); Michael J. Fox, Stafford, NY (US); Timothy M. Nieves, Geneseo, NY (US)

(73) Assignee: Delphi Technologies Inc., Troy, MI (US)

( * ) Notice: Subject to any disclaimer, the term of this patent is extended or adjusted under 35 U.S.C. 154(b) by 90 days.

(21) Appl. No.: 10/439,384

(22) Filed: May 16, 2003

(65) Prior Publication Data

US 2004/0226527 A1 Nov. 18, 2004

(51) Int. Cl.[7] ..... F01L 1/34

(52) U.S. Cl. ..... 123/90.17; 123/90.15; 74/568 R; 92/121

(58) Field of Search ..... 123/90.12, 90.15, 123/90.16, 90.17, 90.31; 74/568 R; 464/1, 2, 160; 92/121, 122

(56) References Cited

U.S. PATENT DOCUMENTS 5,535,705 A * 7/1996 Eguchi et al. ..... 123/90.17
5,797,361 A * 8/1998 Mikame et al. ..... 123/90.17
6,276,322 B1 * 8/2001 Sekiya et al. ..... 123/90.17
6,311,655 B1 * 11/2001 Simpson et al. ..... 123/90.17
6,378,477 B1 * 4/2002 Fukuhara et al. ..... 123/90.17
6,386,164 B1 * 5/2002 Mikame et al. ..... 123/90.17
6,637,390 B1 10/2003 Dauer et al.

* cited by examiner

*Primary Examiner*—Thomas Denion
*Assistant Examiner*—Jaime Corrigan
(74) *Attorney, Agent, or Firm*—Patrick M. Griffin

(57) ABSTRACT

A fast-acting rotor-locking mechanism for a vane-type camshaft phaser. A straight-sided locking pin is disposed in a bushing in the rotor and is urged into a sprocket well by a return spring. A pad disposed at the bottom of the well is a travel stop for the pin. When the pin is fully seated against the pad, the pad covers a portion of the end of the pin. The uncovered portion of the pin end, exposed to oil pressure for unlocking the pin when it is fully seated, is decreased over the prior art pin, permitting use of a lighter locking spring having a lower spring rate. Because of the lighter locking spring, the pin accelerates more rapidly and unlocks significantly faster than in a comparable prior art phaser.

9 Claims, 3 Drawing Sheets

FAST-ACTING LOCK PIN ASSEMBLY FOR A VANE-TYPE CAM PHASER

TECHNICAL FIELD

The present invention relates to vane-type camshaft phasers for varying the phase relationship between crankshafts and camshafts in internal combustion engines; more particularly, to such phasers wherein a locking pin assembly is utilized to lock the phaser rotor with respect to the stator at certain times in the operating cycle; and most particularly, to an improved locking pin assembly having a fast-acting release.

BACKGROUND OF THE INVENTION

Camshaft phasers for varying the phase relationship between the crankshaft and a camshaft of an internal combustion engine are well known. In a typical vane-type cam phaser, a controllably variable locking pin is slidingly disposed in a bore in a rotor vane to permit rotational locking of the rotor to the sprocket, and hence to the stator, under certain conditions of operation of the phaser and engine. A known locking pin mechanism includes a return spring to urge an end of the pin into a hardened seat disposed in the pulley or sprocket (pulley/sprocket) of the phaser, thus locking the rotor with respect to the stator. The rotor may be formed of aluminum, and a steel bushing is pressed and staked into the bore at a predetermined axial location to guide the pin. In at least one prior art embodiment, the pin is shouldered, which shoulder engages the rotor bushing as a limit stop to pin travel. In operation, the pin is forced from the bushing and well in the pulley/sprocket to unlock the rotor from the stator by pressurized oil supplied from a control valve in response to a programmed engine control module (ECM).

A prior art phaser has at least two shortcomings that are overcome by an improved phaser in accordance with the invention.

First, the pin and the seat typically include mating annular bevels to center the pin in the seat and thereby minimize angular lash between the rotor and the sprocket while locked. If the pin is permitted to engage the seat fully, however, the pin may become jammed into the seat and not respond reliably to opening oil pressure. Therefore, a shoulder is provided on the pin to limit travel thereof. It is known that, with repeated use, the pin shoulder can displace the rotor bushing axially, resulting in erratic operation of the locking pin mechanism.

Second, when it is desired to engage the pin to lock the rotor to the sprocket, oil pressure is withheld from the pin end axial face in the well, allowing the spring force to eventually (in milliseconds) overcome the force exerted on the pin end face by the diminishing oil pressure. The force required is proportional to the surface area of the end of the pin. A rapid locking response is benefited by a relatively strong spring (high spring rate); however, in the reverse situation, that of unlocking the pin, a high rate spring results in a relatively slow unlocking response. Hydraulic unlocking force on the pin end is constant but spring resistance increases as the spring is progressively compressed. Thus, the pin initially assumes a relatively high linear velocity which then may slow significantly before the pin is fully withdrawn from the sprocket, resulting in a relatively slow response overall.

What is needed is a means for increasing the withdrawal rate of the locking pin during unlocking of the rotor from the stator/sprocket.

It is a principal object of the present invention to increase the speed of response of a vane-type camshaft phaser in unlocking a rotor from a stator/sprocket.

It is a further object of the invention to increase the locking stability of a rotor-locking mechanism in a vane-type camshaft phaser.

SUMMARY OF THE INVENTION

Briefly described, in a rotor-locking mechanism for a vane-type camshaft phaser in accordance with the invention, the locking pin is a straight-sided pin disposed in a bushing in the rotor. The prior art pin shoulder is omitted, permitting the pin to travel without restraint into a well in the sprocket. The pin is urged conventionally into the well by a return spring. A pad partially covering the bottom of the sprocket well is a travel stop for the pin. When the pin is fully seated against the pad, the pad covers a predetermined first portion of the surface area of the end of the pin. A second and uncovered portion of the pin end is exposed to oil pressure for unlocking the pin when it is fully seated. Thus, the pressure area available for unseating the pin is decreased over the prior art pin, permitting use of a lighter locking spring having a lower spring rate.

A principal benefit of the improved configuration is that, as soon as the pin begins to retract in response to oil pressure on the uncovered portion of the pin, the remainder of the pin becomes uncovered, immediately increasing the total hydraulic force on the pin. Because of the lighter locking spring, the pin accelerates more rapidly and unlocks significantly faster than in a comparable prior art phaser.

A secondary benefit is that the reduced surface area of the pin at locking makes it less sensitive to low-pressure variations in oil pressure and accidental unlocking.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
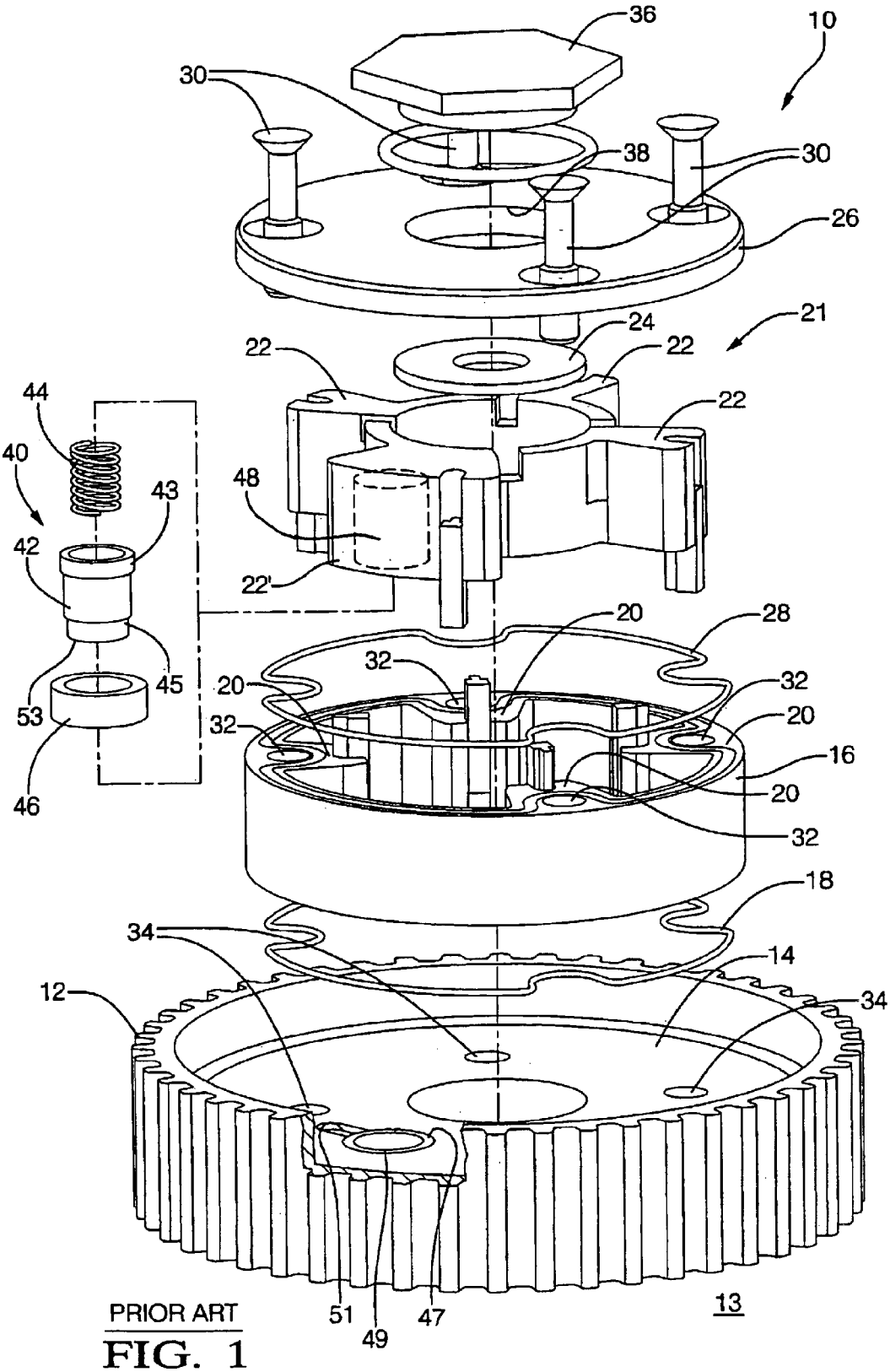
PRIOR ART FIG. 1
FIG. 1 is an exploded isometric view of a typical prior art vane-type camshaft phaser, with the pulley/sprocket partially sectioned to reveal the pin well, guide and channel.

Referring to FIG. 1, a typical prior art vane-type cam phaser 10 includes a pulley or sprocket 12 for engaging a timing chain or belt (not shown) operated by an engine crankshaft (not shown). The upper surface 14 of pulley/sprocket 12 forms a first wall of a plurality of hydraulic chambers in the assembled phaser. A stator 16 is disposed against surface 14 and is sealed thereto by a first seal ring 18. As discussed below, stator 16 is rotationally immobilized with respect to pulley/sprocket 12. Stator 16 is provided with a plurality of inwardly-extending lobes 20 circumferentially spaced apart for receiving a rotor 21 including outwardly extending vanes 22 which extend into the spaces between lobes 20. Hydraulic advance and retard chambers are thus formed between lobes 20 and vanes 22. A thrust washer 24 is concentrically disposed against rotor 21, and cover plate 26 seals against stator 16 via a second seal ring 28. Bolts 30 extend through bores 32 in stator 16 and are received in threaded bores 34 in pulley/sprocket 12, immobilizing the stator with respect to the pulley/sprocket. In installation to a camshaft of an internal combustion engine 13, phaser 10 is secured via a central bolt (not shown) through thrust washer 24 which is covered by cover plug 36 which is threaded into bore 38 in cover plate 26.

A locking bolt mechanism 40 comprises a hollow locking pin 42 and annular shoulder 43, return spring 44, and bushing 46. Spring 44 is disposed inside pin 42, and bushing, pin, and spring are received in a blind, longitudinal bore 48 (shown in phantom view) formed in an oversize vane 22' of rotor 21, an end portion 45 of pin 42 being extendable by spring 44 from the underside of the vane. A pin guide 47 is disposed in a well 49 formed in pulley/sprocket 12 for receiving end portion 45 of pin 42 when extended from bore 48 to rotationally lock rotor 21 to pulley/sprocket 12 and, hence, stator 16. The axial stroke of pin 42 is limited by interference of shoulder 43 with bushing 46. A shallow channel 51 formed in pulley/sprocket 12 extends from below guide 47 and intersects upper surface 14 in a region of that surface which forms a wall of a selected advance or retard chamber in the assembled phaser. Thus, when oil is supplied to advance the rotor with respect to the stator, oil also flows through channel 51 to bring pressure to bear on the axial face 53 of pin end portion 45, causing the pin to be forced from guide 47 and thereby unlocking the rotor from the stator.

Figure 2:
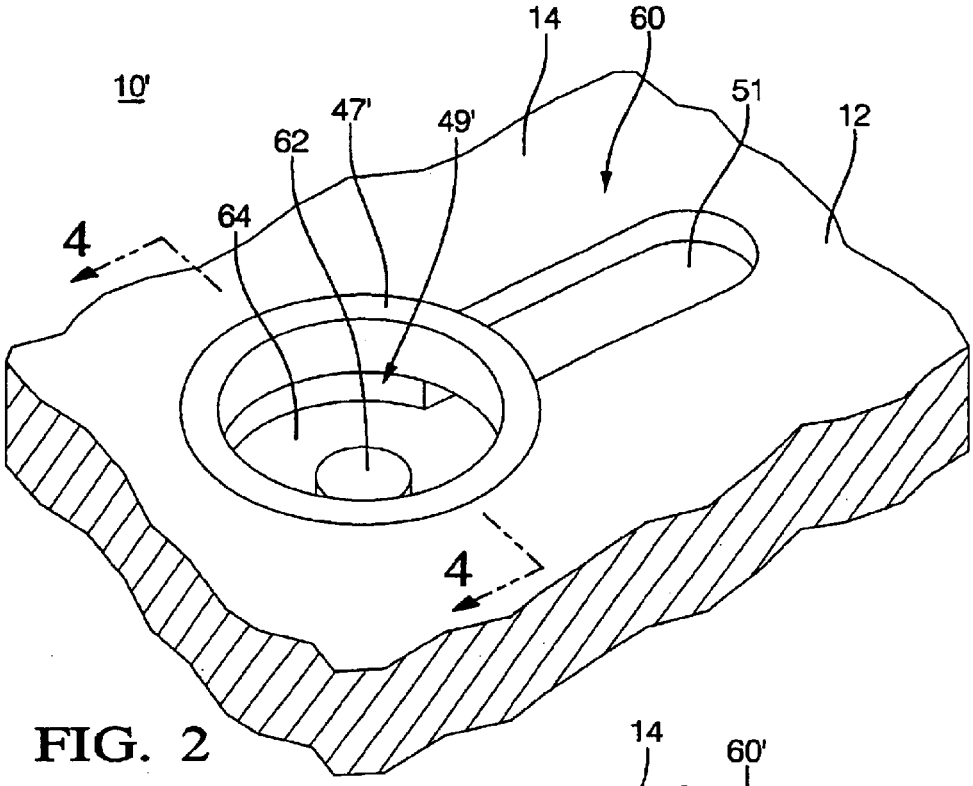
FIG. 2 is an isometric view of a portion of a cam phaser sprocket, showing a first embodiment of a pin-receiving well and guide in accordance with the invention.
Figure 4:
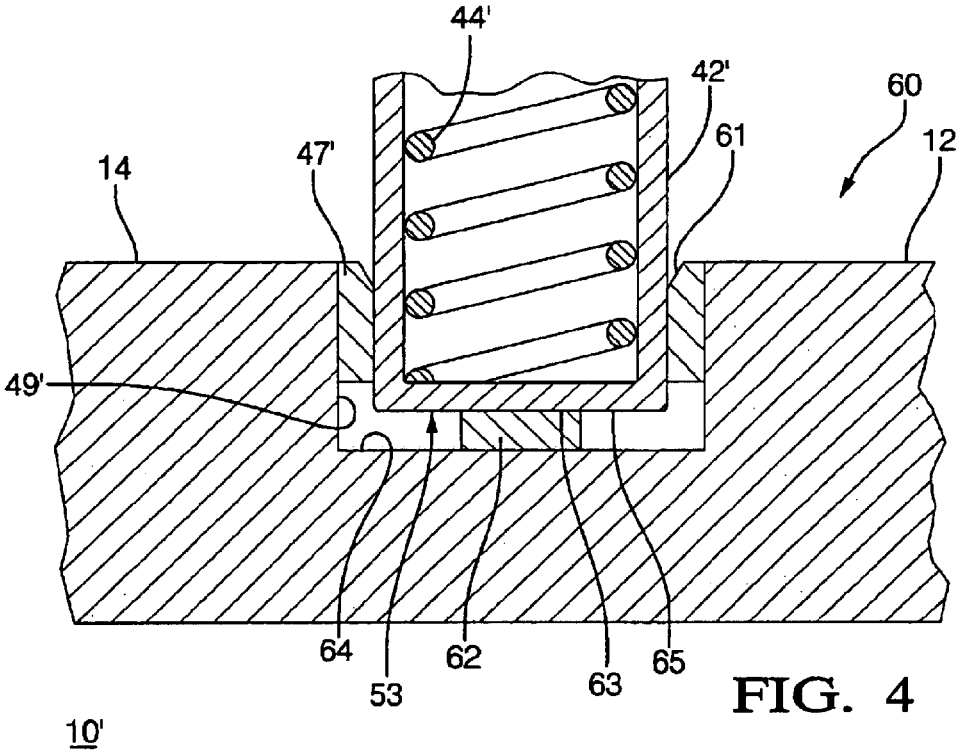
FIG. 4 is an elevational cross-sectional view of the first embodiment shown in FIG. 2, taken along line 4—4 and showing a locking pin in locked position in the well.

Referring to FIGS. 2 and 4, a first embodiment 60 of an improved fast-acting locking pin release mechanism for an improved camshaft phaser 10' is shown. A first modified well 49', preferably cylindrical, is formed in surface 14 of pulley/sprocket 12, extending to a depth greater than the intended stroke of locking pin 42' which is modified to omit prior art shoulder 43. Preferably, a pin guide 47', similar to pin guide 47, is press-fit into well 49' and may be chamfered 61 at the entrance thereof to facilitate receiving of pin 42'. A pad 62 is provided, preferably centrally of well 49', as a stroke-limiting stop for pin 42'. The thickness of pad 62 is selected to yield a predetermined length of stroke for pin 42' into pulley/sprocket 12. Pad 62 is preferably formed of a durable metal, such as stainless steel, and may be formed separately from well 49' and mounted as by welding to bottom surface 64 thereof; or, alternatively, pad 62 may be formed integrally with surface 64 as by machining thereof in known fashion. As in the prior art, an oil-supply channel 51 for unlocking the rotor from the stator is formed in pulley/sprocket 12, extending from below guide 47' and intersecting surface 14 in a region of that surface which forms a wall of a selected advance or retard chamber in the assembled phaser.

In operation, when axial face 53 of pin 42' is fully seated against pad 62, the pad covers a predetermined covered portion 63 of the surface area of the end portion of the pin. Uncovered portion 65 of the pin end is exposed to oil pressure controllably supplied for unlocking the pin. Thus, the pin end area available initially for unseating the pin is decreased over the prior art pin, permitting use of a lighter locking spring 44' having a lower spring rate. As noted above, a principal benefit of the improved configuration is that, as soon as the pin begins to retract in response to oil pressure on uncovered portion 65 of the pin, covered portion 63 of the pin becomes uncovered, immediately increasing the total hydraulic force on the pin. Because of the lighter locking spring, the pin accelerates more rapidly and unlocks significantly faster than in prior art phaser 10. The surface area of the pad and the spring constant may be mutually optimized without undue experimentation to provide a desired locking and release performance of the locking pin.

Figure 3:
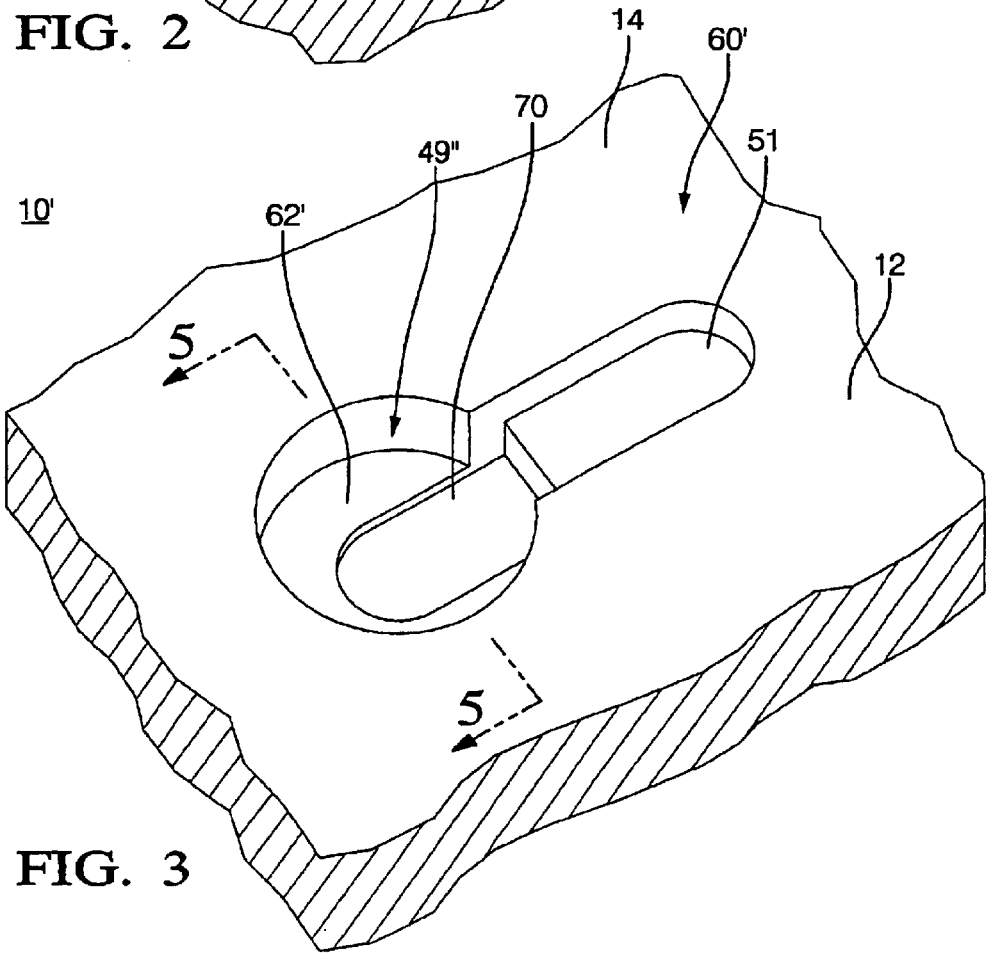
FIG. 3 is an isometric view of a portion of a cam phaser sprocket, showing a second embodiment of a pin-receiving well in accordance with the invention, the pin guide being omitted for clarity.
Figure 5:
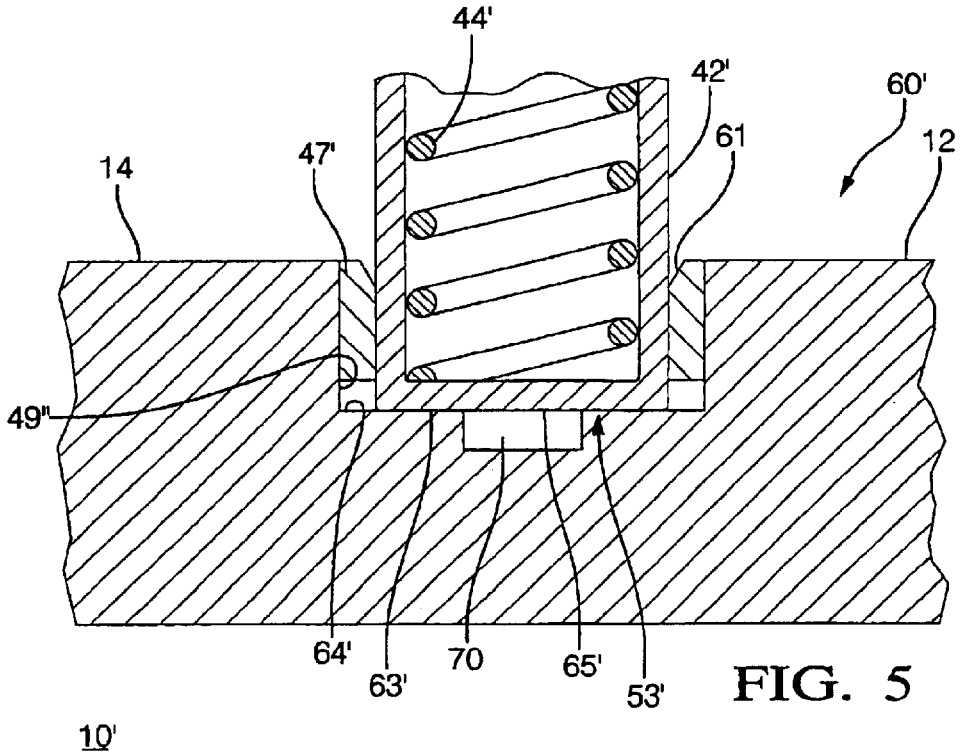
FIG. 5 is an elevational cross-sectional view of the second embodiment shown in FIG. 3, taken along line 5—5 and showing a locking pin in locked position in the well, the pin guide being included for clarity.

Referring to FIGS. 3 and 5, a second embodiment 60' of an improved fast-acting locking pin release mechanism for an improved camshaft phaser 10' is shown, having a well bottom configuration substantially the inverse of that shown in first embodiment 60. A second modified well 49", preferably cylindrical, is formed in surface 14 of pulley/sprocket 12, extending to a depth equal to the intended stroke of locking pin 42' which is modified to omit prior art shoulder 43.

Preferably, a pin guide 47' (omitted for clarity from FIG. 5), similar to pin guide 47 in FIG. 4, is press-fit into well 49" and may be chamfered 61 at the entrance thereof to facilitate receiving of pin 42'. As in the prior art, an oil-supply channel 51 for unlocking the rotor from the stator is formed in pulley/sprocket 12, extending from below guide 47' and intersecting surface 14 in a region of that surface which forms a wall of a selected advance or retard chamber in the assembled phaser. Channel 51 extends into well 49" via a channel extension 70 to form ring pad 62'. Thus, at full locking position of pin 42', the covered portion 63' of the pin end portion is defined directly by portions of well bottom 64', and the uncovered portion 65' is defined by extension 70. As in first embodiment 60, the surface area of the well bottom and the spring constant may be mutually optimized without undue experimentation to provide a desired locking and release performance of the locking pin.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A locking pin mechanism for rotationally locking the rotor of a camshaft phaser to a stator thereof, the stator being fixedly mounted on a camshaft pulley/sprocket, comprising:

a) a locking pin slidably disposed in a bore of said rotor and extendable toward said pulley/sprocket, said locking pin having an end portion and a surface area of an axial face of said end portion;

b) a pin return spring for urging said pin toward said pulley/sprocket;

c) a well formed in said pulley/sprocket for receiving said end portion of said locking pin when urged therein by said spring, said well including a bottom surface;

d) a pad disposed on said bottom surface of said well for partially covering said axial face when said pin is extended into said well by a predetermined distance; and e) a channel extending into said well and defining an uncovered portion of said axial face.

2. A locking pin mechanism for rotationally locking the rotor of a camshaft phaser to a stator thereof, the stator being fixedly mounted on a camshaft pulley/sprocket, comprising:

a) a locking pin slidably disposed in a bore of said rotor and extendable toward said pulley/sprocket, said locking pin having an end portion and a surface area of an axial face of said end portion;

b) a pin return spring for urging said pin toward said pulley/sprocket;

c) a well formed in said pulley/sprocket for receiving said end portion of said locking pin when urged therein by said spring, said well including a ring pad for engaging and partially covering said axial face when said pin is extended into said well by a predetermined distance; and d) a channel extending into said well and defining an uncovered portion of said axial face.

3. An internal combustion engine, comprising a camshaft phaser including a locking pin mechanism, said mechanism having a locking pin slidably disposed in a bore of said rotor and extendable toward said pulley/sprocket, said locking pin having an end portion and a surface area of an axial face of said end portion, a pin return spring for urging said pin toward said pulley/sprocket, a well formed in said pulley/sprocket for receiving said end portion of said locking pin when urged therein by said spring, means disposed in said well for partially covering said axial face when said pin is extended into said well by a predetermined distance, defining a covered portion and an uncovered portion of said face, and means for introducing pressurized oil against said uncovered portion to overcome said spring and initiate unlocking of said locking pin from said pulley/sprocket.

4. A camshaft phaser, comprising a locking pin mechanism for rotationally locking the rotor of the phaser to a stator thereof, said stator being fixedly mounted on a camshaft pulley/sprocket, said mechanism including a locking pin slidably disposed in a bore of said rotor and extendable toward said pulley/sprocket, said locking pin having an end portion and a surface area of an axial face of said end portion, a pin return spring for urging said pin toward said pulley/sprocket, a well formed in said pulley/sprocket for receiving said end portion of said locking pin when urged therein by said spring, means disposed in said well for partially covering said axial face when said pin is extended into said well by a predetermined distance, defining a covered portion and an uncovered portion of said face, and means for introducing pressurized oil against said uncovered portion to overcome said spring and initiate unlocking of said locking pin from said pulley/sprocket.

5. A locking pin mechanism for rotationally locking the rotor of a camshaft phaser to a stator thereof, the stator being fixedly mounted on a camshaft pulley/sprocket, comprising:

a) a locking pin slidably disposed in a bore of said rotor and extendable toward said pulley/sprocket, said locking pin having an end portion and a surface area of an axial face of said end portion;

b) a pin return spring for urging said pin toward said pulley/sprocket;

c) a well formed in said pulley/sprocket for receiving said end portion of said locking pin when urged therein by said spring;

d) means disposed in said well for partially covering said axial face when said pin is extended into said well by a predetermined distance, defining a covered portion and an uncovered portion of said face; and e) means for introducing pressurized oil against said uncovered portion to overcome said spring and initiate unlocking of said locking pin from said pulley/sprocket.

6. A locking pin mechanism in accordance with claim 5 further comprising:

a) a bushing disposed in a vane of said rotor vane for slidably guiding said pin in said vane; and b) a pin guide disposed in said well for slidably guiding said pin end portion in said pulley/sprocket.

7. A locking pin mechanism in accordance with claim 5 wherein said covered portion becomes uncovered and also exposed to said pressurized oil as said pin is forced away from said covering means by said pressurized oil.

8. A locking pin mechanism in accordance with claim 5 wherein said well includes a bottom surface and wherein said means for partially covering includes a pad disposed on said bottom surface for engaging and defining said covered portion of said axial face.

9. A locking pin mechanism in accordance with claim 5 wherein said well includes a ring pad for engaging and covering said covered portion of said axial face, and wherein said means for introducing pressurized oil includes a channel defining said uncovered portion of said axial face.

* * * * *